United States Patent [19]

Fry

[11] Patent Number: 4,782,634

[45] Date of Patent: Nov. 8, 1988

[54] BUILDING CONSTRUCTION

[75] Inventor: Geoffrey W. Fry, Sassafrass, Australia

[73] Assignee: G. & M. Fry Pty. Ltd., Victoria, Australia

[21] Appl. No.: 13,705

[22] Filed: Feb. 12, 1987

[51] Int. Cl.[4] ..... E04D 15/00

[52] U.S. Cl. ..... 52/125.1; 52/127.2; 52/741

[58] Field of Search ..... 52/741, 127.2, 125.1

[56] References Cited

U.S. PATENT DOCUMENTS

| | | | |
|---|---|---|---|
| 3,974,618 | 8/1976 | Cortina | 52/125.1 X |
| 4,058,952 | 11/1977 | Donnelly | 52/741 |
| 4,251,974 | 2/1981 | Vanderklaauw | 52/125.1 X |
| 4,467,585 | 8/1984 | Busby | 52/741 |
| 4,640,070 | 2/1987 | Moffat | 52/741 X |

*Primary Examiner*—Carl D. Friedman

*Attorney, Agent, or Firm*—Holman & Stern

[57] ABSTRACT

A building construction and method of constructing a building including at least a lower level and a roof permits elevation of the roof of the original building as a unitary structure to a sufficient additional height to enable an additional level to be constructed intermediate the lower level and the raised roof. Vertically extendable stabilizing members are installed in the original building structure and are later used to support the roof structure after raising it so that an additional floor level can be built over the original level without destruction of the original roof or building of a new roof. Hydraulic ram devices may be used to raise the roof.

21 Claims, 2 Drawing Sheets

BUILDING CONSTRUCTION

BACKGROUND OF THE INVENTION

1. Field of the Invention

The present invention relates to the field of building construction. In particular the present invention relates to a building construction and a method of constructing multi-level buildings.

The method of the present invention is particularly suitable for use with truss-roofed structures. The construction method of the present invention may be applied to single and multi-level buildings of all kinds, including dwellings and commercial structures as well as prefabricated and temporary buildings.

The present invention will hereafter be described with particular reference to bi-level constructions nevertheless it will be appreciated that it is not thereby limited to such applications.

2. Description of the Prior Art

For a variety of reasons, buildings and in particular dwellings for housing originally constructed as single level structures are sometimes extended to include at least one additional level, thus increasing living space without encroaching upon surrounding land space.

The procedures for adding a second level to a house for example, require complete dismantling of the existing roof structure and are relatively expensive and time consuming.

A householder also must put up with considerable inconvenience during the construction period which may last 6–7 weeks. Inconvenience arises not only because services such as gas, water, electricity etc. must be disconnected at various times during the construction process but also because of disruption to normal living processes resulting from the presence of building personnel and materials.

SUMMARY OF THE INVENTION

It is an object of the present invention to provide an improved method of building construction which at least alleviates the disadvantages associated with subsequent addition of a further level to a building. A further object of the present invention is to alleviate the costs associated with the addition of a further level to a building.

The construction method of the present invention is especially suitable for framed constructions such as brick veneer, weatherboard and other clad constructions. The construction method also may be adapted to some solid constructions.

The construction method of the present invention may be applied to buildings of all shapes and sizes. The construction method typically may be applied to the first level of a buildings e.g. where it may be required to extend the building to include a second level at a later date.

The construction method of the present invention may also be applied to the second level of a building where it may be required to extend the building to include a third level at a later date.

The construction method of the present invention may be applied to various roof structures, e.g. gable, hipped etc. Preferably the roof structure is of truss design.

The construction method of the present invention essentially permits a further level to be "spliced" intermediate the existing level and the roof structure without dismantling of the existing roof structure.

To this end the process of the present invention contemplates elevating the existing roof as a complete structure. Where only part of the entire building is to be extended it will be clear that the corresponding portion only of the existing roof structure needs to be elevated. This may be readily achieved by constructing the portion of the roof to be elevated separately from the rest of the roof structure. The portion of the roof structure not being elevated may be constructed by substantially conventional techniques. The further level may then be constructed in the space between the elevated roof structure and existing level by essentially conventional methods.

The construction method of the present invention may be essentially conventional up to and including the top plates or roof bearing members.

In conventional construction methods ceiling joints may be fixed to the top plates or roof bearing members. Ceiling joists may be typically 38×100 mm in cross-section.

According to the present invention relatively heavy ceiling joists eg. 50×250 mm in cross-section, preferably are fixed to the top plate or roof bearing members. It is common to use relatively heavy ceiling joists in multi-level construction since these function as floor joists for the next level of the building. In conventional multi-level construction methods the bottom plate of the upper level typically is fixed to the ceiling joists of the lower level.

In conventional single level construction methods the roof frame may be supported directly on the top plates or roof bearing members. According to the present invention an additional or second "top plate" member may be provided across the ceiling joists. The second "top plate" member may be adapted to function as the top plate for the next level of construction.

According to the present invention the roof frame may be supported on the second top plate member. It is preferable to fix the roof frame to the second top plate member.

The second top plate may be elevated with the roof structure. The roof structure may be elevated in any convenient manner. The roof structure may be elevated with a crane or similar apparatus or pushed up with hydraulic or mechanical aids such as rams or similar jacking devices.

To improve stability of the structure during the elevating process one or more stabilizing members may be provided. The stabilizing members preferably are provided during construction of the lower level of the building.

The stabilizing members may be associated with the walls of the building. Preferably the stabilizing members are associated with the peripheral walls of the building. Stabilizing members additionally may be associated with partition walls of the building.

The stabilizing members may provide a supporting role for the roof structure or they may be associated with supporting members such as wall studs of the lower level of the building.

The stabilizing members preferably are extendable. Each stabilizing member may include two or more telescoping parts adapted to move between extended and contracted positions. The telescoping parts may include a first or stationary part and a second or movable part. The second or movable part may be adapted to nest within the first or stationary part when the stabilizing member is in the contracted position.

The stabilizing members may be provided in any suitable manner. In one form each stabilizing member may comprise a stationary tubular part and a piston part slidably movable therein. The piston part may be tubular or it may be of solid construction. The stabilizing members may be of any suitable cross-section e.g. circular, rectangular, square etc.

Preferably each stabilizing member comprises a pair of nested tubular parts. The internal tubular part preferably is slidable relative to the external tubular part.

The stabilizing members may be associated with the walls of the building in any convenient manner. Each stabilizing member preferably is fixed to the wall frame of the building. In one form the stationary part of each stabilizing member may be fixed between the top and bottom plates of the frame of the building. Each stationary part preferably is fixed so that it lies substantially parallel with the wall studs of the frame.

The stationary parts of the stabilizing members may be passed through respective apertures formed at least in the top plates of the frame. Each stationary part may include one or more anchor brackets for fixing thereof to the top and bottom plates respectively. The stationary part preferably is fixed to the plate by means of bolts or other suitable fixing means.

With the movable part of each stabilizing member nested within the corresponding stationary part each movable part may be fixed to the second top plates in any convenient manner. Each movable part may include an anchor bracket for fixing the movable part to e.g. the underside of the second top plate. Alternatively the movable part may be passed through an aperture in the second top plate and the anchor bracket may be fixed to the upper side of the second top plate. The anchor bracket may be fixed to the second top plate in any convenient manner eg. by means of bolts.

Each stabilizing member preferably includes means for locking the extendable parts thereof together against relative movement. Locking means may be provided for locking the parts of the stabilizing member in the contracted position. Locking means additionally may be provided for locking the parts of the stabilizing member in the extended position. Locking means may be provided in any suitable manner. In on form the locking means may comprise one or more aligned apertures in the first and second parts of the stabilizing member. The, or each, pair of aligned apertures may be adapted to receive a pin or peg member suitable for locking the movable parts of the stabilizing member against relative movement.

Upon installation each stabilizing member may be locked in the contracted position. The stabilizing members may be adapted in this manner to fix the second top plates and associated roof structure to the bottom plates. The second top plates preferably are not permanently fixed to the frame e.g. by means of nails.

The number of stabilizing members required will depend on the size and shape of the building and roof structure. Where the building is not too large, say 100 sq meters and is approximately rectangular in plan, approximately 6 stabilizing members located along opposite peripheral walls of the building may be sufficient. The stabilizing members preferably are distributed along the load bearing walls of the building, i.e. along those walls which actually carry the roof structure.

The above method of construction may be adopted for a single or multi-level building where an intention may exist to extend the building to a further level at a later time. Costs for adapting or conditioning the building to further extension in this manner may be relatively modest when compared with the alternative costs and inconvenience of completely dismantling and reconstructing the entire roof structure.

When it is desired to extend the building to include a further level, the stabilizing members may be "unlocked" eg. by removing the locking pins, and the roof structure may be elevated as a whole so that construction of the further level may proceed. The stabilizing members preferably are again locked in the extended or elevated position.

The roof structure preferably is elevated by means of hydraulic rams. The hydraulic rams may be placed under the roof structure prior to elevation of the roof. The rams preferably are actuated by a common hydraulic circuit to ensure level operation. In one form each hydraulic ram may be located under a bottom chord of the roof structure.

Rigid beams preferably are attached to the underside of the roof structure prior to elevation thereof. The rigid beams may be attached to the underside of the bottom chords of the roof structure. The rigid beams preferably are attached to the bottom chords at or in the vicinity of the junction of each bottom chord and respective rafter of the roof structure. The rigid beams may be placed adjacent opposite load bearing walls of the building. Each rigid beam may comprise a steel section such as an inverted channel.

Preferably the hydraulic rams are located under the rigid beams. The upper end of the piston of each hydraulic ram may be attached to a rigid beam. The hydraulic rams preferably are located around the external periphery of the building. The hydraulic rams may be temporarily fixed to the external wall of the building and/or surrounding ground area for stable operation. Preferably each ram is located adjacent to or in the vicinity of a stabilizing member.

According to one aspect of the present invention there is provided a building construction including at least a lower level and a roof which permits elevation of the roof as a unitary structure to a sufficient height to enable an additional level to be constructed intermediate the lower level and roof.

According to a further aspect of the present invention there is provided a method of constructing a multi level building including a lower level and a roof comprising the steps of elevating the roof as a unitary structure to a height sufficient to enable an additional level to be constructed intermediate the lower level and roof and constructing the additional level by substantially conventional techniques.

BRIEF DESCRIPTION OF THE DRAWINGS

A preferred embodiment of the present invention will now be described with reference to the accompanying drawings wherein.

DETAILED DESCRIPTION

Figure 1:
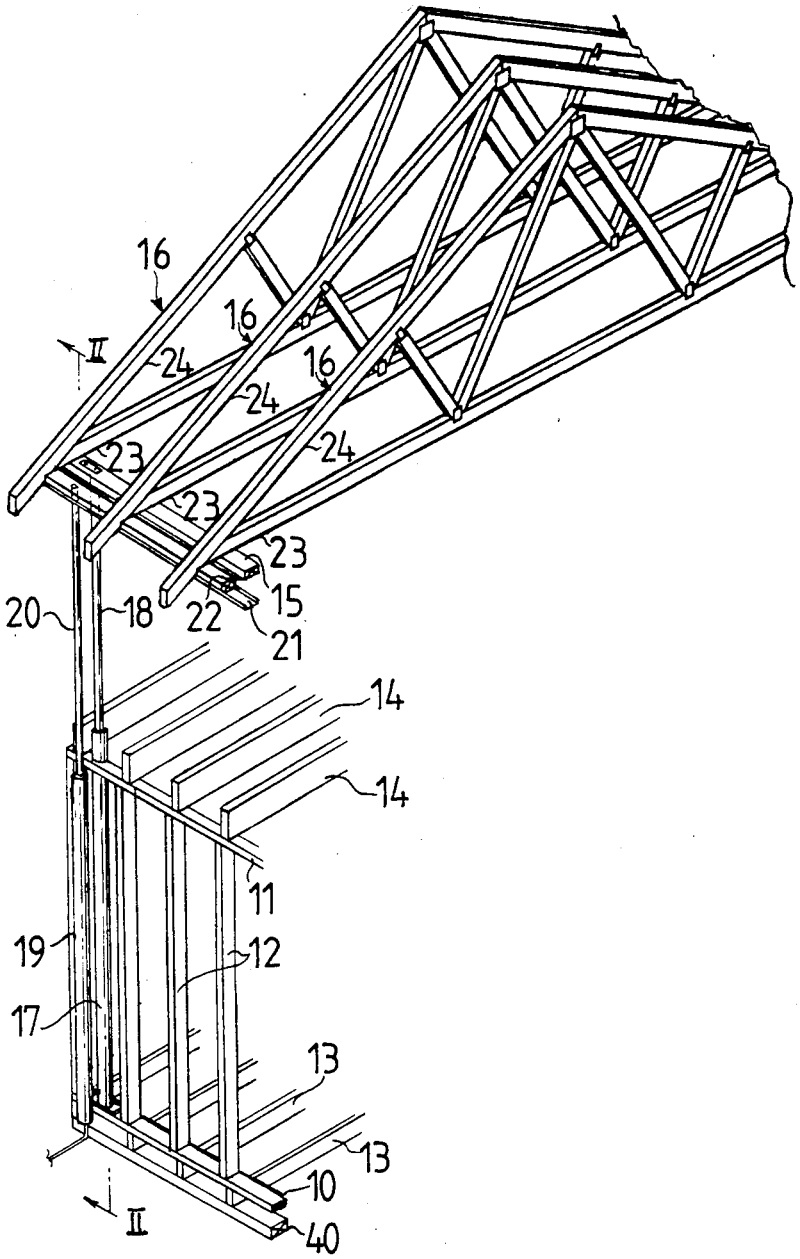
FIG. 1 is a perspective view in an elevated position of a portion of a single level building frame constructed in accordance with the present invention.

FIG. 1 shows a portion of a building frame constructed in accordance with the present invention. The building frame may be clad in any convenient manner. The frame includes bottom and top plates 10, 11 respectively separated by vertical wall studs 12. Bottom plate 10 rests on floor joists 13. Floor joists 13 rest on bearer 40 and stumps 41 (refer FIG. 2). Ceiling joists 14 are supported on top plates 11. Ceiling joists 14 are relatively heavy eg. 50×250 mm since these will function as floor joists for the next level of the building.

A second top plate 15 rests on ceiling joists 14, although shown in the elevated position in FIG. 1. The second top plate 15 supports a roof frame including trusses 16, constructed in a conventional manner.

Mounted within the wall frame area stabilizing members 60 each including stationary part 17 and piston or movable part 18 slidable therein. Stationary part 17 is fixed between bottom and top plates 10, 11. The manner of fixing part 17 is more fully described with reference to FIG. 2. Piston part 18 is fixed at its free end to top plate 15. The manner of fixing of piston part 18 is more fully described with reference to FIG. 2.

Hydraulic rams 61 each comprising cylinder 19 and piston 20 are used for elevating the roof structure. Cylinder 19 is attached (temporarily) to the wall cladding (not shown) and suitably supported on the ground. The free end of piston 20 is fixed to a rigid beam member. The rigid beam member includes a metal section 21 attached to roof trusses 16 via an intermediate member 22. The rigid beam preferably is attached to the trusses approximately at the junction of the bottom chord 23 and respective rafter 24 of each roof truss 16. The hydraulic ram is connected to a source of hydraulic fluid (not shown).

Figure 2:
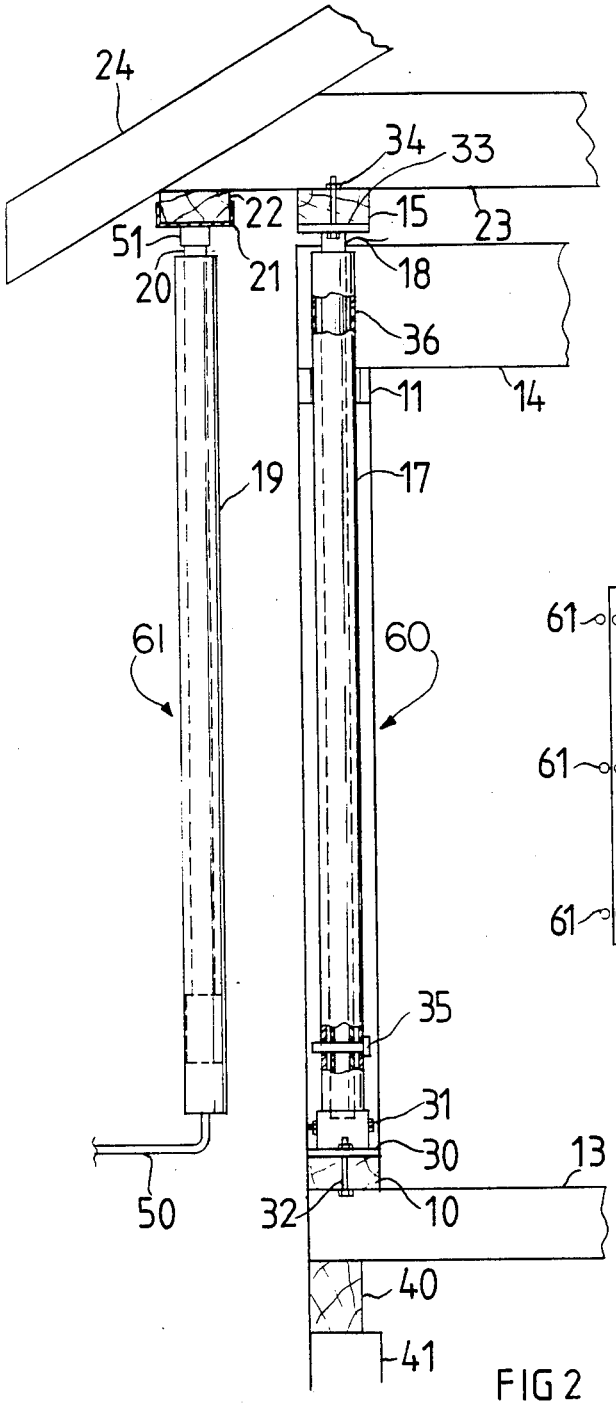
FIG. 2 is a cross-sectional view taken along line II—II of FIG. 1 in the non-elevated position.

Referring to FIG. 2, the stationary part 17 is attached to bottom plate 10 by means of a bracket piece 30. Bracket piece 30 is attached to the lower stationary part 17 by means of a bolt and nut assembly 31 and to bottom plate 10 by means of bolts and nuts eg. 32. Alternatively, bracket piece 30 may be welded to stationary part 17. The upper end of stationary part 17 is passed through an aperture formed in top plate 11. The upper end of part 17 may be fixed to the top plate 11 by means of bolts if desired.

The upper or free end of piston part 18 is attached to the second top plate 15 by means of a bracket piece 33. The upper end of piston part 18 is welded or otherwise attached to bracket piece 33. Bracket piece 33 is attached to the second top plate 15 by means of bolts and nuts eg. 34.

A steel pin 35 is passed through aligned apertures in the lower end portions of stationary part 17 and piston part 18 for locking the parts 17, 18 together. A further aperture 36 is provided towards the upper end of stationary part 17. Aperture 36 is aligned with the aperture in the lower end portion of part 18 when part 18 is raised to its elevated position.

Pin 35 must be removed before the roof structure may be elevated. After elevation, pin 35 is passed through aperture 36 and the aligned aperture in the lower end portion of part 18 to lock the parts 17, 18 together in the elevated position.

Cylinder 19 of the hydraulic ram is supported firmly under rigid beam member 21, 22. A supply of hydraulic fluid is connected to the cylinder via supply line 50. The free end of piston 20 may be secured to metal section 21 by means of a threaded engagement in collar 51. Collar 51 may be permanently attached to metal section 21 eg. by means of welding.

Figure 3:
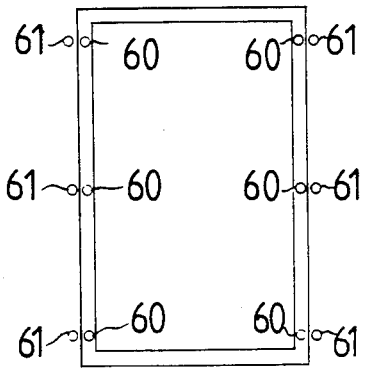
FIG. 3 is a schematic top plan view showing the location of stabilizing members and hydraulic jacks relative to the peripheral walls of a building.

FIG. 3 shows the preferred location of stabilizing members 60 and hydraulic rams 61 relative to the peripheral walls of a building. Fewer or more stabilizing members and hydraulic rams may be required depending on roof weight, shape, floor plan, size of the building etc.

It will be appreciated that various alterations, modifications and/or additions may be introduced into the constructions and arrangements of parts previously described without departing from the spirit or ambit of the present invention.

I claim:

1. A method of constructing a building including at least a lower level and a roof, which method permits raising of at least a portion of the roof as a unitary structure to an elevated position to enable an additional level to be constructed intermediate the lower level and roof, said method comprising the steps of:

providing a plurality of stabilizing members adapted to maintain at least lateral alignment of said roof during raising thereof, each stabilizing member being extendable and having at least first and second parts, said second part of each member being movable relative to said first part of each member between a first position in which said second part is substantially contracted relative to said first part and a second position in which said second part is extended relative to said first part;

beginning construction of the lower level of the building;

locating said stabilizing members in said first contracted position in respective wall cavities of the lower level of said building during initial construction of said lower level so that the first part of each stabilizing member is held against movement relative to said lower level of said building;

constructing said roof during initial construction of the building so that at least a portion of the roof may be subsequently raised to said elevated position as a unitary structure;

fixing the second part of each stabilizing member to said roof;

completing construction of said lower level by substantially conventional techniques;

selectively raising at least said portion of said roof to an elevated position as a unitary structure when it is desired to construct an intermediate level; and extending said stabilizing members to said second position while maintaining lateral alignment of the roof to enable said additional level to be constructed intermediate the lower level and said roof in the elevated position by substantially conventional techniques.

2. A method as claimed in claim 1 wherein said lower level includes a bottom plate and a top plate and wherein:

said step of locating said stabilizing members comprises fixing the first part of each stabilizing member between said bottom plate and said top plate.

3. A method as claimed in claim 2 wherein the first part of each stabilizing member includes a lower bracket, and said step of fixing said first part of each stabilizing member comprises:

fixing said lower bracket to said bottom plate.

4. A method as claimed in claim 3 wherein the second part of each member includes an upper bracket, and said step of fixing said second part comprises:

fixing said upper bracket to said second top plate.

5. A method as claimed in claim 2 wherein the second part of each member includes an upper bracket, and said step of fixing said second part comprises:

fixing said upper bracket to said second top plate.

6. A method as claimed in claim 1 wherein said roof includes a second top plate and wherein:

said step of fixing said second part of each stabilizing member comprises fixing each second part to said second top plate.

7. A method as claimed in claim 6 comprising:

providing ceiling joists associated with the lower level of said building;

supporting said second top plate on said ceiling joists; and supporting said roof on said second top plate.

8. A method as claimed in claim 7 and further comprising:

utilizing said ceiling joists as floor supports for said additional level.

9. A method as claimed in claim 1 and further comprising:

forming each stabilizing member of telescoping parts.

10. A building including at least a lower level and a roof supported on the lower level, constructed so that at least a portion of the roof is raisable as a unitary structure to an elevated position to enable an additional level to be constructed intermediate the lower level and roof, the building comprising:

respective wall cavities in the lower level of the building;

a plurality of stabilizing members for maintaing at least lateral alignment of said roof during raising thereof, each stabilizing member being extendable and having at least first and second parts, said second part being movable relative to said first part between a first position in which said second part is substantially contracted relative to said first part and a second position in which said second part is extended relative to said first part, said stabilizing members being located in said first contracted position in said respective wall cavities during initial construction of said lower level and being fixed so that said first part is held against movement relative to said lower level of said building;

a roof constructed during initial construction of the building so that at least a portion thereof is subsequently raisable as a unitary structure; and means for fixing said second part of each stabilizing member to said raisable portion of said roof.

11. A building as claimed in claim 10 wherein:

said lower level comprises a bottom plate and a top plate; and said first part of each stabilizing member is fixed between said bottom plate and said top plate.

12. A building as claimed in claim 11 wherein:

said roof comprises a second top plate; and said second part of each stabilizing member is fixed to said second top plate.

13. A building as claimed in claim 11 and further comprising:

a bracket on each first part, said bracket being fixed to said bottom plate.

14. A building as claimed in claim 13 and further comprising:

a bracket on each second part, said bracket being fixed to said second top plate.

15. A building as claimed in claim 14 wherein:

said first and second parts of each stabilizing member comprise telescoping parts.

16. A building as claimed in claim 15 wherein:

said lower level of said building comprises ceiling joists;

said second top plate is supported on said ceiling joists when said stabilizing members are in said first contracted position; and said second top plate supports said roof.

17. A building as claimed in claim 10 wherein:

said roof comprises a second top plate; and said second part of each stabilizing member is fixed to said second top plate.

18. A building as claimed in claim 17 and further comprising:

a bracket on each second part, said bracket being fixed to said second top plate.

19. A building as claimed in claim 17 wherein:

said lower level of said building comprises ceiling joists;

said second top plate is supported on said ceiling joists when said stabilizing members are in said first contracted position; and said second top plate supports said roof.

20. A building as claimed in claim 19 wherein:

said ceiling joists are constructed for serving as floor supports for said additional level.

21. A building as claimed in claim 10 wherein:

said first and second parts of each stabilizing member comprise telescoping parts.

* * * * *